United States Patent [19]

Jamison

[11] Patent Number: 4,935,283

[45] Date of Patent: Jun. 19, 1990

[54] COMESTIBLE POUCH MATERIAL HAVING PREFORMED SPOUT ZONE

[76] Inventor: Mark D. Jamison, 3333 Sharon Pl., Zion, Ill. 60099

[21] Appl. No.: 273,772

[22] Filed: Nov. 21, 1988

Related U.S. Application Data

[62] Division of Ser. No. 215, Jan. 2, 1987, Pat. No. 4,793,121.

[51] Int, Cl.[5] ..... B65D 35/50

[52] U.S. Cl. ..... 428/174; 222/107; 222/575; 383/906; 428/35.2; 428/35.5; 428/178

[58] Field of Search ..... 222/107, 541, 575; 383/44, 906; 206/484, 632; 428/35.2, 35.5, 174, 179, 178, 346

[56] References Cited

U.S. PATENT DOCUMENTS

| | | | |
|---|---|---|---|
| 3,917,116 | 11/1975 | Mason | 222/107 |
| 4,275,840 | 6/1981 | Staar | 222/107 |
| 4,491,245 | 1/1985 | Jamison | 222/107 |

*Primary Examiner*—James Seidleck

*Attorney, Agent, or Firm*—Low and Low

[57] ABSTRACT

A pre-forming technique for web material utilized to make flexible pouches for fluent products comestibles and non-comestibles in form-and fill equipment of well known type characterized by the initial stretching displacement of each web from its normal plane and in a configuration corresponding to the ultimate spout configuration prior to forming of the pouch with the spout therein, thereby preventing undesired blockage of the spout by unintended adherence of the packaging film in the spout zone during sealing operations. The technique is especially desirable in pouches having a unique and complex reversely curved discharge passageway.

6 Claims, 2 Drawing Sheets

FIG. 1
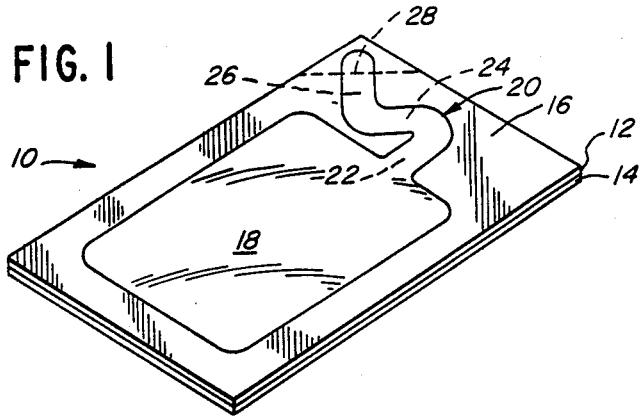
FIG. 2
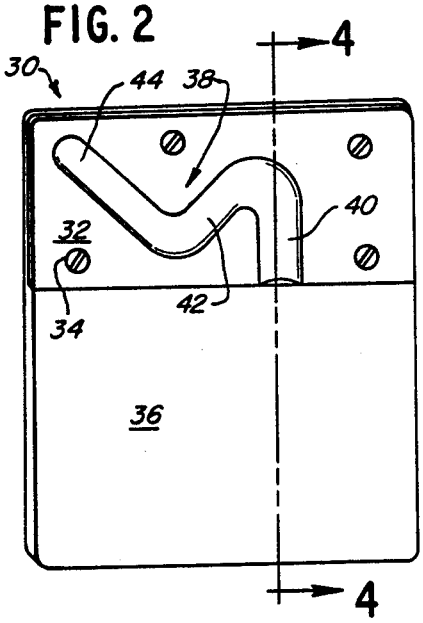
FIG. 3
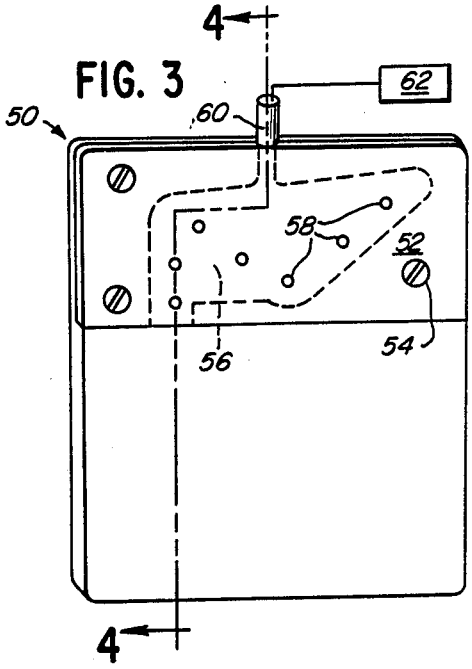
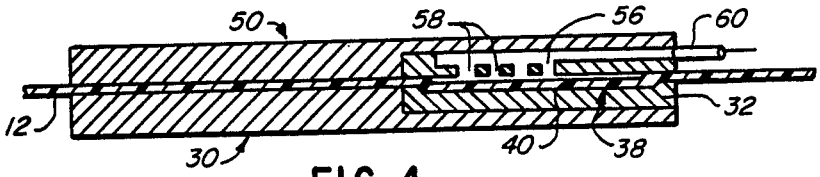
FIG. 4

FIG. 5
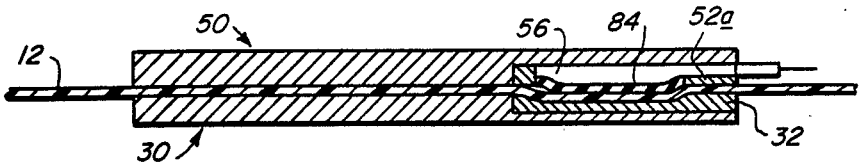
FIG. 6
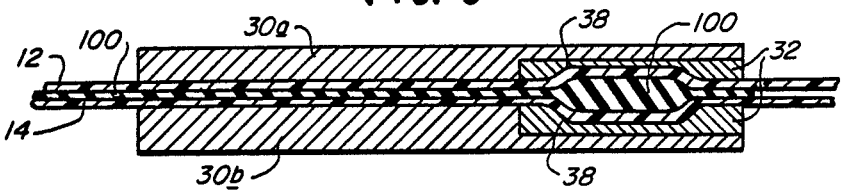
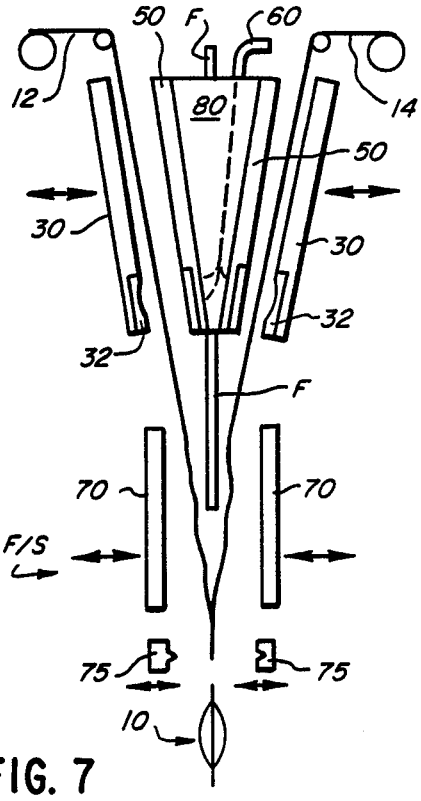
FIG. 7
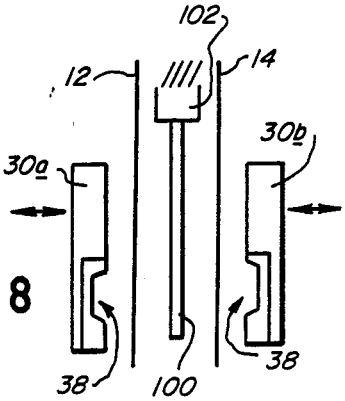
FIG. 8
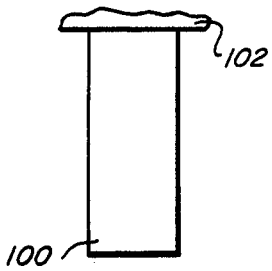
FIG. 9

COMESTIBLE POUCH MATERIAL HAVING PREFORMED SPOUT ZONE

This is a division of application Ser. No. 07/0215 filed Jan. 2, 1987, now U.S. Pat. No. 4,793,121.

BACKGROUND OF THE INVENTION

In the manufacture of flexible pouches for dispensing purposes wherein the pouch includes a dispensing spout or internal channel through which the package contents may be expressed through the spout upon rupture or tear removal of a discharge spout terminal end portion of the package and squeezing of the package, there exists the fabrication difficulty of so forming and peripherally heat sealing the package so that the relatively narrow discharge spout passageway through the sealed package area will be reliably present when it is desired to use the pouch contents.

Such dispensing packages are well known in the art, and are illustrated in prior U.S. Pat. No., as Kaplan Re. 24,251 or Carlisle U.S. Pat. No. 3,878,977, among others. One of the most successful of these pouch packages is that marketed under the trademark "SPOUT-PAK" and shown in my prior U.S. Pat. No. 4,491,245 issued to Jamison on Jan. 1, 1985 and entitled Liquid Dispensing Container. The dispensing pouch there shown is especially characterized by a tortuous, serpentine and reversely curved discharge passageway which is highly effective to control discharge of the package contents while simultaneously providing drip-free characteristics.

It will be seen that in the manufacture of pouches containing fluid contents, as various comestibles on the order of mustard, ketchup, syrup, or other liquids and viscous materials as lotions , alcohol, wine, paint, etc., when the package is fabricated from peripherally sealed face-to-face contacting sheets of web material, typically multi-layer laminates including diverse gas and liquid barrier materials as polymer-coated or laminated metal foil and the like with suitable printed indicia, it is important that upon rupture of a terminal portion of a discharge passageway as by tearing off a corner part of the package, the ready discharge of the contents may be effected and that the discharge passage defined through the sealed pouch sheets from the main supply of the contents be readily opened by separation of the unsealed webs therealong upon applied pressure to the contents portion of the pouch so that the contents will flow from the supply area of the pouch outwardly through the much narrower spout passageway without hindrance.

The importance of proper flow upon pouch squeezing dispensing pressure is vital to the success of all pouches of the type contemplated, and especially significant in the provision of a unique complex and reliable pouch such as the aforesaid "SPOUT-PAK" pouch wherein the discharge passageway has a serpentine and reversely directed configuration, as a failure in the opposing pouch walls defining the spout passageway to properly distend or flex under fluid pressure would render the package virtually useless and undesireable to the consumer or other user.

BRIEF SUMMARY OF THE INVENTION

In the conventional fabrication of pouches of any given type and especially those having discharge spouts therein, it is customary to advance a pair of webs of the packaging material which, as noted, are of a selected flexible laminate having heat seal characteristics and which may contain desired printing indicia and the like, and, at appropriate downstream locations, whether by rotary or reciprocating die means, the facing webs will be peripherally sealed except for a small marginal area between the overlying and confronting webs and the spout area defined in the seal pattern. Thereafter, the package will be filled through the unsealed marginal area and this area finally sealed to confine the package contents therewithin and the finished, filled pouch severed from the advancing web material.

Alternatively, as is known, a single web of packaging material may be advanced in planar form to a position whereat the web is longitudinally folded about a center line as it advanced thereby to convert the flat web into a C-fold configuration with one-half of the web overlying and coextensive with the other half of the web.

The package will thus be sealed about three marginal edges, one including the spout passageway, with the fourth side being defined at least by the aforesaid fold line, with similar filling and closing techniques.

Such procedures generally of forming pouch packages and filling the same are well known in the art and may be found, for example, in Class 53 of the United States patent classification system, and include vertical form-and-fill machines, horizontal machines, and the like.

In any event, after the film or web material is folded or disposed with the two sides of the potential package in face-to-face relation, and especially with relatively small sizes of certain pouch packages, the film has a tendency to stick or tack together in the narrow area thereof defining the discharge passageway, as a substantial area of the confronting webs are sealed on either side thereof as compared with the contents-receiving reservoir of the pouch wherein only a relatively limited peripheral sealing occurs.

With the narrow and tortuous channel of the unsealed discharge passageway being present in a large sealed area of the pouch and with the seals closely defining the passageway, the contacting but unsealed faces of the web defining the passageway are also capable of receiving a modest amount of heat from the sealing dies closely thereadjacent on the lateral sides at the spout area as well as slightly pressed face-to-face relation as the sealing dies effect bonding pressure on the web material immediately adjacent to the spout zone.

By the invention herein, the respective webs of the pouch are initially each pre-distended slightly and thereby stretched in the area defining the discharge spout passageway or internal channel, whereby the likelihood or tendency of the webs to tack or adhere together in the critical passageway zone is substantially obviated.

This may be accomplished by the application of requisite compressed air or mechanical pressure to the web or webs as a pre-forming step just prior to being brought into overlying face-to-face relationship with pouch formation product filling and final sealing thereof with severance of the pouch from the web.

While this distension or displacement of the spout zone can be effected as the film is continuously moving, it is preferable from a die and fabrication standpoint to effect the same while the film material is stopped in intermittent motion, thereby permitting the use of a simple relatively planar die assembly and ready association with conventional pouch forming equipment.

The displacement or distension is not rigid so as, to be in the nature of a molded and deformed area, but is rather just slightly stretched out of the original plane of the web, and freely flexible back theretoward as is a common property of the thin pouch material.

BRIEF DESCRIPTION OF THE DRAWINGS

FIG. 1 is a perspective view of a dispensing pouch of a preferred form including a tortuous discharge spout or passageway including reversely directed portions;

FIG. 2 is a perspective view of one plate and die member in pre-forming the spout in a pouch wall;

FIG. 3 is a perspective view of a cooperating forming pressure supply plate used with the plate of FIG. 2;

FIG. 4 is a fragmentary view in cross-section illustrating action of the plates of FIGS. 2 and 3 on a length of pouch web;

FIG. 5 is similar to FIG. 4 and disclosing a modified form thereof;

FIG. 6 is similar to FIG. 5 and disclosing a further modified form thereof;

FIG. 7 is a generally diagrammatic view of the invention as incorporated in a conventional vertical pouch form-and-fill machine;

FIG. 8 is a diagrammatic view of the modified form of the invention seen in FIG. 6; and;

FIG. 9 is a fragmentary side elevation of the forming element of FIGS. 6 and 8.

DETAILED DESCRIPTION OF THE INVENTION

With reference to FIG. 1, there is illustrated a pouch of the type which is preferably subjected to the pre-forming operations of the instant invention in fabrication of the pouch, and especially in which fabrication techniques are or have been hitherto difficult as noted above. More particularly, the pouch 10 corresponds to that shown in U.S. Pat. No. 4,491,245 to Jamison and is typically defined by a pair of confronting lengths of web material 12, 14 which may be either separate sheets a or single large or wide web longitudinally folded in half, and wherein the webs are peripherally sealed as by heat sealing about the entire periphery of the pouch package as indicated at 16, whereby the two confronting webs are in sealed in relation to each other and are leak proof with respect to the pouch contents until access is desired. While illustrated in accordance with the pouch of the Jamison patent, it will be evident that the invention herein is applicable to other pouches.

The pouch 10 includes within the sealed boundary 16 the primary product supply area at 18 within which is received the product to be dispensed, such as a generally liquid comestible or non-comestible on the order of syrup, mayonnaise, ketchup, wine, creams, adhesives, and the like. The pouch further includes an unsealed tortuous dispensing spout passageway between the webs 12, 14 at 20, which specifically includes an initial passageway portion 22 communicating with supply 18, an intermediate passageway portion 24 which is reversely directed from the initial passageway 22 back toward the primary product area 18, and finally the terminal discharge passageway portion 26 which is again reversely directed with respect to the intermediate portion 24 to lead outwardly toward the sealed package periphery.

Suitable rupture-facilitating means including indicia, notching, or a score line is indicated at 28 in usual manner, whereby in use, the corner portion of the pouch is readily torn or cut away by the user along the line 28 thereby to remove a sealed area from the terminal portion of the passageway 26 and permit the pouch contents within the portion 18 to be expressed through the passageway upon the application of digital pressure to the pouch supply at 18. Upon pressure being applied to the contents, the same will flow through the passageway 20 for appropriate dispensing.

As disclosed in some detail in my aforesaid patent, the tortuous and reversely angled passageway 20 effects a highly reliable self-sealing to prevent unwanted drippage or leakage of the pouch upon relaxation of squeezing pressure notwithstanding the fact that the package may include further contents or remaining contents in the pouch product supply area 18.

In the generally conventional fabrication of pouches by disposition of confronting webs between suitable seal means so as to effect a peripheral pouch seal as at 16 with an unsealed contents receiving portion 18 and a spout or discharge passageway at 20, and especially with the highly effective spout configuration including the tortuous and reversely curved portions shown in FIG. 1, hitherto it has been a problem to fabricate such a pouch in that there is a tendency for the opposing film material, usually a polymer-foil laminate, to adhere together along the rather narrow discharge passageway 20. Should this occur in the fabrication thereof, upon use of the pouch, pressure applied to the area 18 would not result in sufficient opening of the passageway 20 to permit contents to be freely or fully expressed therethrough. It will be seen that while no significant difficulty was encountered in unwanted sealing of the opposed pouch walls in the product-receiving area 18, that by virtue of the relatively narrow unsealed area defining the tortuous discharge passageway 20 as compared with the sealed area 16 therearound as applied by usual sealing dies, not only was the unsealed area of the ultimate passageway relatively small and narrow, but also sealing pressures and temperatures would be quite proximate to the potential passageway and enhance the unintended and unwanted tacking or sealing of the potential passageway to result in unwanted blockage at the time of use.

Such is obviated by the pre-forming technique of the instant invention. In the fabrication of pouches, specifically pouches of the type contemplated herein, it is conventional to advance confronting faces of sealable webs between die members which appropriately close upon the confronting webs and seal a desired peripheral zone therearound, while leaving a portion of the periphery unsealed until product is introduced into the pouch area 18, and thereafter finally sealing the pouch. In so doing, web material is conventionally fed vertically on well known "form-and-fill" machines, or alternatively, advanced horizontally across the table area in a generally similar form of filling wherein product will be introduced laterally of the web rather than longitudinally of the machine direction of feed.

The invention herein is readily utilized with either vertical or horizontal package forming equipment. The utilization of the subject pre-forming system is especially valuable in cooperation with formation of the unique tortuous and reversely directed spout passageway in a pouch of the type shown in FIG. 1, and achieves most important benefits in the manufacture of such packages.

To this end, each web 12, 14 which will be subsequently disposed in confronting relation for appropriate peripheral sealing, pouch filling, and final sealing, is initially directed through a pre-forming station at which the ultimately formed spout portion at 20 is given pretreatment in the separate web before package formation.

A preferred means therefor is seen in FIGS. 2 and 3 which cooperatively define a set of forming dies acting on the web material prior to the pouch filling and closing station, and the cooperation of the dies seen in FIGS. 2 and 3 in acting on a web is seen in FIG. 4. Thus, there is shown in FIG. 2 a plate member 30 which includes a pre-forming die portion 32 as an insert element secured to the main plate as by screws or like means 34. In this manner, the die insert 32 may be replaced when worn, or in the alternative, may be readily altered to provide specific and varying configuration relationships for differing discharge passageways.

It will be seen that while the face of the insert 32 is quite generally flush with the face 36 of the primary plate 30, that the insert 32 includes a recessed groove 38 therein which has the configuration of the desired tortuous channel to be provided in the ultimate package at 20 as seen in FIG. 1. To this end, the recessed shallow groove or channel 38 includes an initial leg 40, a reversely directed intermediate portion 42, and a terminal portion 44 which correspond respectively to the ultimate channel or passageway portions 22, 24, 26 in the finished pouch of FIG. 1. It will be seen that the groove 38 stops short of the outer periphery of the die plate 30 which in the preferred embodiments, substantially conforms to the overall dimensions of the ultimate pouch, inasmuch as the ultimate terminal area at the periphery of the pouch will be sealed in peripheral seal 16 to preclude any leakage from the pouch prior to removal of a corner portion of the pouch at 28 to permit utilization of the terminal spout portion 26.

Cooperating with the die plate 30 is a like air pressure die plate 50 which similarly has a removable insert 52 which may be secured thereto as required in known manner, as by machine screws 54. The die plate 52, as indicated in phantom lines and as also seen in the side elevational view of FIG. 4, is relieved at its rear face to define with plate 50 a plenum chamber for gaseous fluid as air at 56. As seen in FIG. 3, the face of insert 52 is provided with a plurality of apertures as at 58 which communicate with chamber 56, while a tubular connection diagrammatically shown at 60 extends from the chamber to a suitable fluid pressure source 62, which may be air or other gas. Air is preferable, as it maybe supplied quite clean and presents no contamination difficulty with the web thereat which forms the interior of the ultimate package.

It is not necessary to have the substantial multiplicity of ports 58 as shown, as only a few would suffice. It is only necessary that the location of the ports be such that the same correspond to the location of the groove 38 in the insert 32 of companion die plate 30.

As is evident from FIG. 4, in operation, a length of web material as at 12 or 14 is introduced between the separated plates 30 and 50, after which the two are caused to relatively approach each other whereupon admission of air pressure into chamber 56 acts through the ports 58 in the insert 52 to distend or slightly stretch the pouch material 12 or 14 so as to cause the same to be forced into and conform to the groove 38 in the die insert plate 32. Depending upon the laminate material employed for the packaging film and its thickness, suitable air pressure is provided to effect the desired deflection as indicated.

While a stretching operation of the type shown with respect to the tortuous groove 38 may be effected with respect to only a single web of the two-web laminate, it is preferable to effect simultaneous distention in forming a spout pattern on both webs 12, 14 in mirror relation and prior to the further sealing and filling of the pouch package.

With this slight stretching effected in the spout area, upon downstream peripheral sealing of the pouch and especially the relatively large areas of the pouch material proximate the tortuous spout passageway, there will be no likelihood of unwanted or adverse tackiness and connection between the laminates 12, 14 in the unsealed spout area. As a consequence, upon ultimate consumer utilization of the pouch, and removal of the tear-away portion along line 28, the package contents will express properly through the tortuous passage 20 without difficulty, while the package will yet retain it no-drip features as recited in the aforesaid Jamison patent.

It is important to observe that only a very slight prestretching is effected by virtue of the quite shallow groove 38, whereby the webs will be virtually in contact at the spout area at the downstream seal station yet will resist unwarranted tacking in the spout zone. There is no deep groove distension whatever that might tend to form a defined semicircular half-tube, for example.

The pre-forming technique of the invention herein may be applied at any convenient upstream point in the formation of the pouch and filling thereof by otherwise generally conventional techniques.

Thus, in FIG. 7 there is diagrammatically illustrated the essential arrangement of a standard vertical form-and-fill apparatus wherein webs 12, 14 respectively defining the opposed pouch walls are separately fed from supply rolls thereof in downwardly converging relation toward a conventional filling and sealing station F/S whereat between intermittent advance of the webs, opposed suitable seal die plates of well known form as at 70, 70 are actuated inwardly to close upon the opposed web 12, 14 about a product filling tube F, whereupon the two webs are sealed about all sides except for a peripheral zone permitting reception therethrough of the filling tube and whereupon in timed relation a product supply is dispensed into the pouch. Thereafter, upon the next intermittent downward actuation of the webs, the pouch moves to the lower position shown, whereat conventional seal and sever bars 75 approach each other to seal off the remaining unsealed zone in which the filler tube F had been located and sever the now-completed and filled pouch from the pouch being formed thereabove.

Such equipment is well known in the art for forming and making bags or pouches in the general manner, whether vertical or horizontal format, and need not be described further, as the same do not form part of the invention herein. In the present invention, the pre-forming station PF is disposed above the initial pouch sealing dies 70, and as indicated includes a die plate as at 30 associated with each web 12, 14 respectively, the said dies having the insert 32 with the desired configuration of the reversely curved tortuous passageway 38 as seen in FIG. 3.

The cooperating pressure plates 50 are conveniently associated in the central zone between the webs 12, 14 and may be carried as by a suitably configured central member 80, whereby during intermittent operation of the apparatus, the webs 12, 14 are respectively clamped by the plates 30, 50 as seen in FIG. 4, and air introduced through a similar line 60 associated with the respective plates 50 thereby to distend the webs in the manner described and as seen in FIG. 4. The filling tube F may extend through the carrier block 80 or may extend laterally into usual and conventional position beneath the block 80 as may be desired and which forms no part of the present invention.

The physical displacement of the film material from the ordinary plane of the webs 12, 14 by the applied pressure is in absolute terms very slight as noted above. Furthermore, the film distention may even be so slight as to be virtually inconspicuous in the filled package, or indeed the film-material may even restore to a substantially flat condition depending upon relative pressure conditions within the package during and after formation. In any event, preforming techniques as applied to the complex tortuous configuration of the spout 20 by the appropriate groove 38 and pressure applying means as by compressed air or mechanical pressure insures high reliability of the ultimate package and that inadvertent blocking or sealing of the discharge spout passage wear channel will not occur.

While in the form of the invention shown in FIGS. 2–4, air is employed as the pressure fluid to effect the displacement of the web into the die groove 38, a liquid pressure medium as water or oil may be utilized in lieu thereof. Thus, in order to prevent obviously undesirable escape of the liquid medium or contamination of the web, a modified insert **52*a* is associated with the pressure plate 50 as seen in FIG. 5, wherein a resilient band or diaphragm of material as rubber 84 is provided in the insert 52*a* in lieu of the open ports 58 as in the insert 52. Thus, liquid pressure in the chamber 56 will act upon the flexible and resilient diaphram 84 to effect the requisite displacement and stretching of the film 12 or 14 into the groove cavity 38 in the plate 30**. While structurally more complex than the preferred embodiment, for given pouch materials or dimensions the same may be useable.

In a slightly different form of the invention as seen in FIG. 6, rather than utilize air pressure to displace the film, a flexible mold member 100 of resilient material, as rubber or elastomeric material, may be provided in the form of a simple rectangular member 100 of sufficient area to embrace the spout zone. The same need not have the specific tortuous form of the ultimate passageway 20. As indicated in FIG. 8 and as shown in comparison to the other forms of the invention in FIG. 6, the elastomeric element 100 is supported by a base member 102 in position to be associated with complementary formed grooves 38 into like opposed dies **30*a*, 30*b*, which are mirror images having like complementary insert plates 32 therein. Thus, as seen in FIG. 8, when the die plates 30*a*, 30*b* approach each other at an intermittent point in web advance, the same clamp about the central resilient mold element 100 thereby to distend and displace the film 12, 14 into each respective groove 38 as indicated in FIG. 6 thereby to achieve the same stretching effect on the respective webs. At the reopening of the plates 30*a*, 30*b*, the now distended web advances downwardly for conventional filling and sealing operations much as in the instance of the FIG. 7** equipment, as will be evident.

While it is possible to form the rubber element 100 into the exact tortuous form of passageway 20, it is preferable not to do so, as closing of the dies **30*a*, 30*b*, will effect the required slight stretching into grooves 38**, while the excess rubber-like material pressed against the webs outside of the groove will prevent any ridging or creasing of the material at the groove edges.

What I claim is:

1. Pre-formed displaced zone pouch material for fabrication into a fluent comestible container having a curvilinear dispensing spout comprising, a substantially planar sheet of flexible and heat sealable material, said sheet having an area thereof normally physically displaced slightly from the normal plane of the material while in unstressed condition, said displaced area comprising a partial potential spout length including three serially connected length portions extending respectively in a first direction, in a second direction extending in a generally rearward direction with respect to said first direction, and a third portion extending again in generally said first direction, whereby upon fabrication of said material into a said pouch, pressures applied to said material generally in the plane thereof during pouch fabrication wherein said displaced areas are brought into confronting relation will not cause unwanted blocking of said displaced area.

2. The preformed displaced zone pouch material for a fluent comestible container as in claim 1 wherein said sheet material is a polymeric film.

3. The preformed displaced zone pouch material for a fluent comestible container as in claim 2 wherein said polymeric film is a multilayer laminate.

4. The preformed displaced zone pouch material for a fluent comestible container as in claim 2 wherein said polymeric film is imprinted with indicia on the side of said film toward which said displaced area extends.

5. The preformed displaced zone pouch material for a fluent comestible container as in claim 1 wherein said sheet material is slightly stretched to form said displaced area.

6. The preformed displaced zone pouch material for a fluent comestible container as in claim 1 wherein said sheet material is disposed in face-to-face relation with a like said sheet with the said displaced area of each said sheet in confronting relation to define said curvilinear spout.

* * * * *